US007176615B2

(12) United States Patent
Song et al.

(10) Patent No.: US 7,176,615 B2
(45) Date of Patent: Feb. 13, 2007

(54) FIELD EMISSION DEVICE HAVING EMISSION-INDUCING AND SUPPRESSING GATES

(75) Inventors: Yoon Ho Song, Daejeon-Shi (KR); Chi Sun Hwang, Daejeon-Shi (KR); Kwang Bok Kim, Daejeon-Shi (KR)

(73) Assignee: Electronics and Telecommunications Research Institute, Daejeon-shi (KR)

( * ) Notice: Subject to any disclaimer, the term of this patent is extended or adjusted under 35 U.S.C. 154(b) by 0 days.

(21) Appl. No.: 10/923,818

(22) Filed: Aug. 24, 2004

(65) Prior Publication Data

US 2005/0057168 A1 Mar. 17, 2005

(30) Foreign Application Priority Data

Aug. 27, 2003 (KR) ..... 10-2003-0059401

(51) Int. Cl.
*H01J 1/62* (2006.01)
*H01J 63/04* (2006.01)
*H01J 1/46* (2006.01)

(52) U.S. Cl. ..... 313/497; 313/495; 313/496; 313/306

(58) Field of Classification Search ..... 313/495–497
See application file for complete search history.

(56) References Cited

U.S. PATENT DOCUMENTS 5,229,331 A * 7/1993 Doan et al. ..... 313/309
5,332,627 A * 7/1994 Watanabe et al. ..... 428/426
5,653,619 A * 8/1997 Cloud et al. ..... 445/24
5,817,201 A * 10/1998 Greschner et al. ..... 445/24
5,955,850 A * 9/1999 Yamaguchi et al. ..... 313/495
6,437,503 B1 8/2002 Konuma et al.
6,541,905 B1 * 4/2003 Fushimi et al. ..... 313/497
6,958,499 B2 * 10/2005 Hwang et al. ..... 313/309

FOREIGN PATENT DOCUMENTS

JP 05-266806 10/1993
JP 07-130306 5/1995
JP 07-240143 9/1995
JP 08-115654 5/1996
JP 10-012166 1/1998

(Continued)

OTHER PUBLICATIONS

Wang et al., "Flat panel display prototype using gated carbon nanotube field emitters", Applied Physics Letters, Feb. 26, 2001, pp. 1294-1296.

(Continued)

*Primary Examiner*—Nimeshkumar D. Patel
*Assistant Examiner*—Natalie K. Walford
(74) *Attorney, Agent, or Firm*—Mayer Brown Rowe & Maw LLP

(57) ABSTRACT

A field emission device including a cathode having an electric field emitter for emitting electrons, a field emission inducing gate for inducing electron emission, and an anode for receiving the emitted electrons. A field emission suppressing gate is interposed between the cathode and the field emission inducing gate for suppressing electron emission, so that problems such as gate leakage current, electron emission due to anode voltage, and electron beam spreading of the conventional field emission device are significantly overcome.

18 Claims, 6 Drawing Sheets

FOREIGN PATENT DOCUMENTS

| | | |
|---|---|---|
| JP | 10-074473 | 3/1998 |
| JP | 10-149778 | 6/1998 |
| JP | 10-199400 | 7/1998 |
| JP | 2001-357773 | 12/2001 |
| JP | 2003-217485 | 7/2003 |
| JP | 2003-229044 | 8/2003 |
| KR | 2002-0066284 | 8/2002 |
| WO | 02/27745 | 4/2002 |

OTHER PUBLICATIONS

Choi et al., "Electrophoresis deposition of carbon nanotubes for triode-type field emission display", Applied Physics Letter, Mar. 12, 2001, pp. 1547-1549.

* cited by examiner

FIELD EMISSION DEVICE HAVING EMISSION-INDUCING AND SUPPRESSING GATES

BACKGROUND

1. Field of the Invention

The present invention relates to a field emission device, and more particularly, to a field emission device comprising a field emission suppressing gate for suppressing electron emission which is interposed between a cathode and a field emission inducing gate.

2. Discussion of Related Art

Field emission devices have been widely used as an electron source of a microwave element, a sensor, a flat panel display, or the like, which emits electrons from a cathode electrode when an electric field is applied to the same in a vacuum or a specific gas atmosphere.

Efficiency of electron emission significantly depends on an element structure, an emitter material, and an emitter shape in the field emission device. At present, the structure of the field emission device is mainly classified into a diode type consisting of a cathode and an anode, and a triode type consisting of a cathode, a gate, and an anode.

The cathode or electric field emitter acts to emit electrons, the gate acts to induce electron emission, and the anode receives the emitted electrons in the triode type field emission device. Since the electric field for electron emission is applied to the gate adjacent to the emitter in the triode type structure, the field emission device may be driven at a low voltage and emission current may be readily controlled as compared to the diode type structure, as a result of the triode type is being actively developed.

Material used for the electric field emitter may include metal, silicon, diamond, diamond like carbon, carbon nanotube, carbon nanofiber, etc., the carbon nanotube and nanofiber are thin and pointed, and stable in themselves, so that they are widely used for the emitter material.

Hereinafter, a Spindt-type field emission device, which is one of the structures widely used among conventional field emission devices, will be described. FIG. 1 is a diagram illustrating a schematic configuration of a Spindt-type field emission device in accordance with the related art.

The Spindt-type field emission device consists of a cathode, a gate, and an anode. The cathode is comprised of a cathode substrate 11, a cathode electrode 12 formed on the cathode substrate, a metal tip 13 with an insulator 21 surrounding the metal tip 13 and having an internal gate opening 22, and a gate electrode 23 formed on the insulator 21. An anode electrode 32 is formed on an anode substrate 31, which is arranged to face the above-mentioned whole cathode and gate structure.

In order to fabricate such a field emission device, the gate opening 22 is formed to have a thickness of about 1 um on the insulator 21 and a sacrificial isolation layer is formed on top of that. Electron beam evaporation is performed to thereby form a self-aligned metal tip 13.

Thus, while a fine pattern should be formed and a self-alignment scheme by means of electron beam evaporation should be performed in the above-mentioned procedure, there is difficulty in application of such a field emission device for implementing a large area display.

Efforts to fabricate the field emission device with a more simplified process have been made to cope with such problem, and the carbon nanotube and carbon nanofiber among electric field emitter materials have been used to meet these efforts.

The carbon nanotube and carbon nanofiber have very small diameters, on the order of nanometer, in themselves while having a long length, on the order of micrometer, so that they are highly suitable for an electron emission source. However, when they are used as the electron emission source by means of an electric field, it is not easy to form a self-aligned electron emitting gate so as to have a structure capable of readily inducing and controlling electron emissions compared to the Spindt-type metal tip of FIG. 1.

FIG. 2 is a diagram illustrating a schematic configuration of a field emission device for a carbon nanotube or carbon nanofiber in accordance with the related art. FIG. 2 differs from FIG. 1 in that the carbon nanotube or carbon nanofiber used for the electric field emitter 14 of the field emission device of FIG. 2 is exposed through a gate opening with a length of 10 um formed within an insulator.

Thus, the emitted electrons flow into the gate to result in a leakage current. In addition, the gate opening is larger compared to the thickness of the insulator, which causes difficulty in controlling electron emission due to an anode voltage, and causes the emitted electron beam to be widely spread when it reaches the anode as compared to its emitting instance.

These phenomena deteriorate the properties of the field emission device, and in particular, they may cause a significant problem when the field emission device is applied for a flat panel display.

SUMMARY OF THE INVENTION

The present invention is directed to a new type of field emission device.

The present invention is also directed to a field emission device, which reduces a leakage current flowing into the gate as an electron emitting electrode and facilitates control of electron emission.

The present invention is also directed to a field emission device, which allows most electrons to be emitted in the carbon nanotube or carbon nanofiber arranged near the gate electrode to thereby overcome the potential leakage current and spreading of the electron beam.

One aspect of the present invention is to provide a field emission device. The field emission device comprises a cathode including a cathode substrate, a cathode electrode formed on the cathode substrate, and an electric field emitter formed on a portion of the cathode electrode; a field emission suppressing gate formed on the cathode substrate to surround the electric field emitter; a field emission inducing gate formed on the field emission suppressing gate; and an anode including an anode electrode facing the electric field emitter for receiving electrons emitted from the electric field emitter, wherein the field emission suppressing gate suppresses electron emission from the electric field emitter, and the field emission inducing gate induces the electron emission from the electric field emitter.

Another aspect of the present invention is to provide a field emission device comprising a cathode including an electric field emitter for emitting electrons, a field emission inducing gate for inducing electron emission, and an anode for receiving emitted electrons, which further comprises a field emission suppressing gate interposed between the cathode and the field emission inducing gate for suppressing the electron emission.

DETAILED DESCRIPTION OF PREFERRED EMBODIMENTS

The present invention will now be described more fully hereinafter with reference to the accompanying drawings, in which preferred embodiments of the field emission device are shown. This invention may, however, be embodied in different forms and should not be construed as limited to the embodiments set forth herein. Rather, these embodiments are provided so that this disclosure will be thorough and complete, and will fully convey the scope of the invention to those skilled in the art.

First Embodiment

Figure 1:
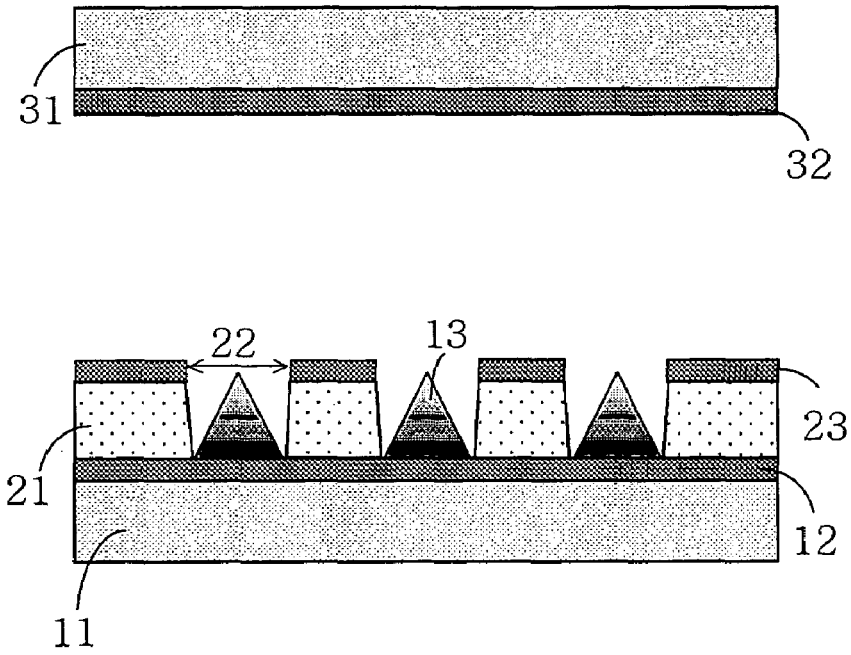
FIG.1 (PRIOR ART)
FIG. 1 is a diagram illustrating a schematic configuration of a Spindt-type field emission device in accordance with the related art.
Figure 2:
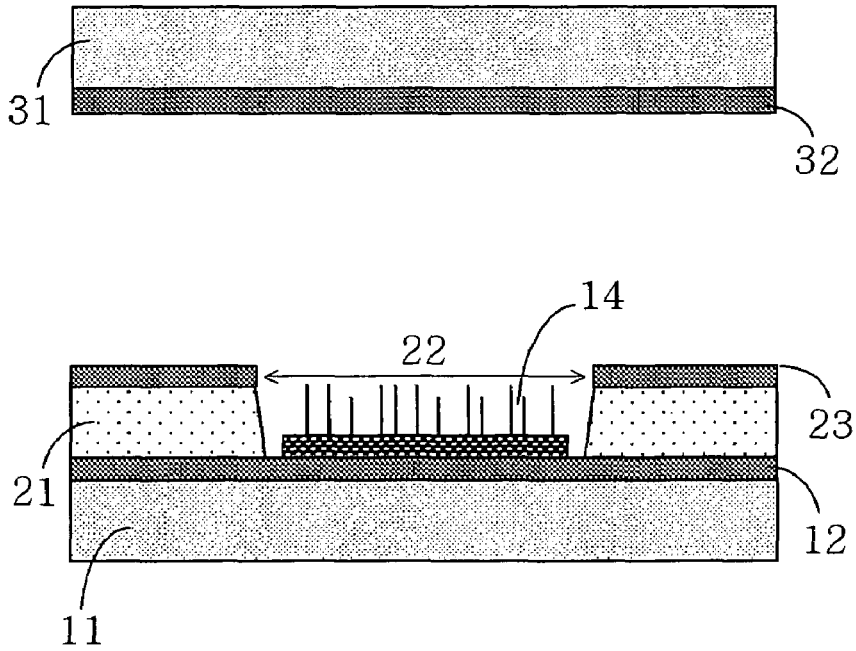
FIG.2 (PRIOR ART)
FIG. 2 is a diagram illustrating a schematic configuration of a field emission device for a carbon nanotube or carbon nanofiber in accordance with the related art.
Figure 3:
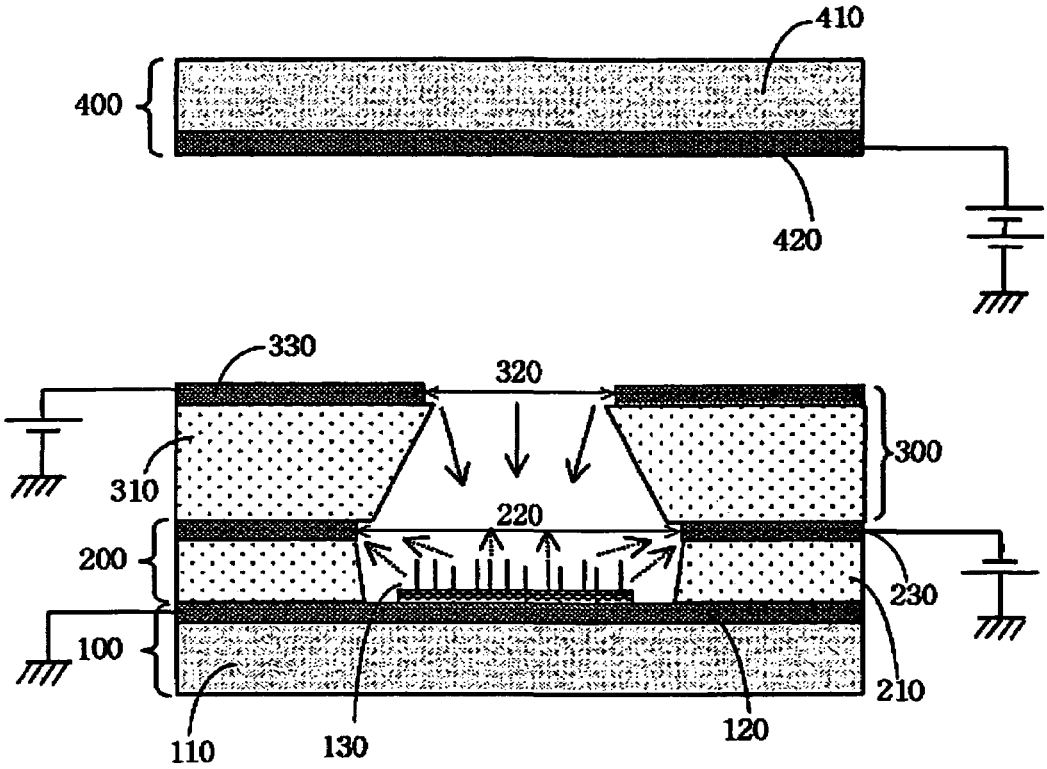
FIG. 3 is a diagram illustrating a schematic configuration of a field emission device in accordance with a first embodiment of the present invention.

FIG. 3 is a diagram illustrating a schematic configuration of a field emission device in accordance with a first embodiment of the present invention.

The field emission device of FIG. 3 comprises a cathode 100, a field emission suppressing gate 200, a field emission inducing gate 300, and an anode 400. This field emission device corresponds to one dot pixel in the field emission display, and a plurality of dot pixels are arranged in a matrix form and a plurality of interconnection lines are also included to apply various signals to each of the dot pixels in an actual process for fabricating the field emission display.

Each of the cathode 100, field emission suppressing gate 200, field emission inducing gate 300, and anode 400 may be formed on a separate substrate, or the cathode 100 and field emission suppressing gate 200 may be formed on one substrate, and the field emission inducing gate 300 and anode 400 may be formed on another substrate. Alternatively, the cathode 100, field emission suppressing gate 200 and field emission inducing gate 300 may be formed on one substrate, and the anode 400 may be formed on another substrate.

The cathode 100 includes, for example, a cathode substrate 110 formed of an insulating substrate such as glass, ceramic or polyimide, a cathode electrode 120 formed of metal, metal compound, etc., on a predetermined region of the cathode substrate 110, and a (thin or thick) film type electric field emitter 130 formed of diamond, diamond like carbon, carbon nanotube, carbon nanofiber, etc. on some portion of the cathode electrode 120. The cathode substrate has, for example, a thickness of about 0.5 mm to 5 mm, and the cathode electrode has a thickness of about 0.1 um to 1.0 um.

The field emission suppressing gate 200 includes a first insulator 210 formed of an oxide layer, a nitride layer, etc., a field emission suppressing gate opening 220 formed to penetrate the first insulator 210, and a field emission suppressing gate electrode 230 formed of metal, metal compound, etc. on some portion of the first insulator 210.

For example, the first insulator 210 and the field emission suppressing gate electrode 230 have a thickness of about 0.5 um to 20 um, and a thickness of about 0.1 um to 1.0 um, respectively, and the field emission suppressing gate opening 220 has a diameter of about 5 um to 100 um.

The field emission inducing gate 300 includes a second insulator 310 formed of a glass material, an oxide layer, a nitride layer, etc., a field emission inducing gate opening 320 formed to penetrate the second insulator 310, and a field emission inducing gate electrode 330 formed of metal, metal compound, etc. on some portion of the second insulator 310. For example, the second insulator 310 and the field emission inducing gate electrode 330 may be formed to have thicknesses of 50 um to 500 um and 0.1 um to 1.0 um, respectively. The field emission inducing gate opening 320 may has a diameter of 50 um to 500 um.

The anode 400 has an anode electrode 420 that may be formed of metal, metal compound, transparent electrode, etc. on an anode substrate 410. The anode substrate 410 is preferably formed of a transparent substrate, and the anode electrode 420 is preferably formed of a transparent electrode. For example, the anode substrate 410 and the anode electrode 420 may be formed to have thicknesses of 0.5 mm to 5.0 mm, and about 0.1 um, respectively.

The cathode 100, field emission suppressing gate 200, field emission inducing gate 300, and anode 400 are vacuum-packaged to have the electric field emitter 130 of the cathode 100 face the anode electrode 420 of the anode 400 through the field emission suppressing gate opening 220 and the field emission inducing gate opening 320.

The electric field emitter 130 may be formed as a thin or thick film, or may be formed of diamond, diamond like carbon, carbon nanotube, carbon nanofiber, etc. using catalytic metal on the cathode electrode 120, or may be formed by means of mixing and printing of paste containing powder type diamond, diamond like carbon, carbon nanotube, carbon nanofiber, which are already synthesized.

The size (diameter) of the field emission suppressing gate opening 220 in the field emission suppressing gate 200 is preferably adjusted to be one to twenty times the thickness of the first insulator 210, which allows electrons emitted from the electric field emitter 130 to be suppressed by means of the field emission suppressing gate electrode 230. When the size exceeds twenty times the thickness of the first insulator, the field emission suppressing gate 200 has difficulty in blocking the electric field induced to the electric field emitter 130 by the field emission inducing gate 300, so that it is difficult to suppress the electron emission from the electric field emitter 130 due to the field emission inducing gate 300. The thickness of the insulator 210 is preferably in a range of about 0.5 um to about 20 um.

The field emission inducing gate 300, as well as the second insulator, acts to suppress the electric field emission by the anode voltage, and may have the effect of focusing the electron beam to allow the electrons emitted from the electric field emitter 130 to move toward a specific region of the anode.

The field emission inducing gate opening 320 of the field emission inducing gate 300 preferably has an inclined inner wall for penetrating the second insulator 310 such that its opening size becomes smaller toward the anode 400 from the cathode 100, so that the electrons emitted from the electric field emitter 130 may be focused on a specific region of the anode electrode 420.

In addition, the size (diameter) of the field emission inducing gate opening 320 of the field emission inducing gate 300 is one to three times the thickness of the second insulator 310, which does not allow the electric field by the anode electrode 420 to be induced to the electric field emitter 130 to thereby suppress the electron emission. When the size exceeds three times the thickness of the second insulator, the field emission inducing gate 300 may not block the electric field induced to the electric field emitter 130 due to the anode voltage applied to the anode electrode 420, which causes difficulty in suppressing the electric field emitter 130 from performing the electric field emission due to the anode voltage. The preferred thickness of the second insulator 310 is in a range of about 50 um to 500 um.

The gate electrode 330 of the field emission inducing gate 300 is formed so as not to cover the inclined inner wall of the field emission inducing gate opening 320, so that the electrons emitted from the electric field emitter 130 may be prevented from flowing to the field emission inducing gate electrode 330.

The cathode 100, field emission suppressing gate 200, field emission inducing gate 300, and anode 400 are attached to face one another by means of spacers (not shown).

In addition, an electric field by the field emission inducing gate electrode 330 is applied toward the electric field emitter 130 so as to have the electrons emitted from the electric field emitter 130 (See solid line arrows shown in FIG. 3), and an electric field by the field emission suppressing gate electrode 230 is applied toward a direction opposite to that of the electric field applied to the electric field emitter 130 by means of the field emission inducing gate electrode (See dotted line arrows shown in FIG. 3) so that the electrons are not emitted from the electric field emitter 130. The potential of the field emission inducing gate electrode 330 may be adjusted to be higher than that of the electric field emitter 130, and the potential of the field emission suppressing gate electrode 230 may be adjusted to be lower than that of the electric field emitter 130.

To that end, as shown in FIG. 3, the electric field emitter 130 may be coupled to a ground state, and a positive voltage and a negative voltage may be applied to the field emission inducing gate electrode 330 and the field emission suppressing gate electrode 230, respectively.

Next, a method for fabricating a field emission display using the field emission device will be described in accordance with preferred embodiments of the present invention.

Figure 4:
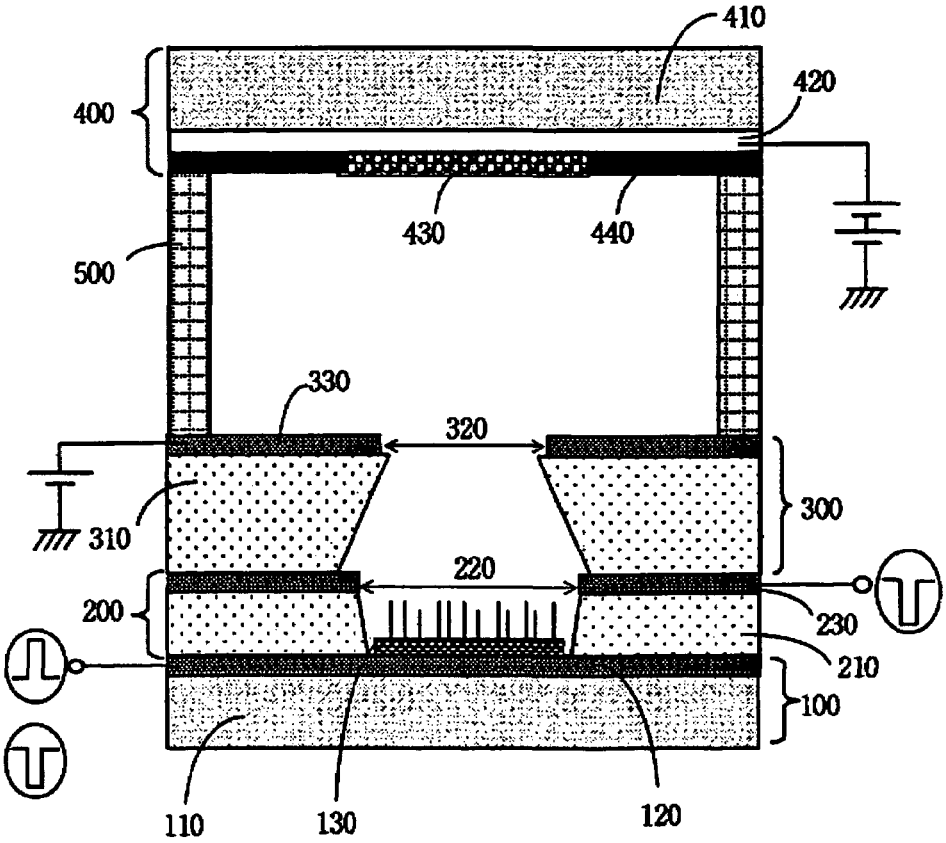
FIG. 4 is a cross sectional view for explaining a configuration of one dot pixel in a field emission device in accordance with a first embodiment of the present invention.
Figure 5:
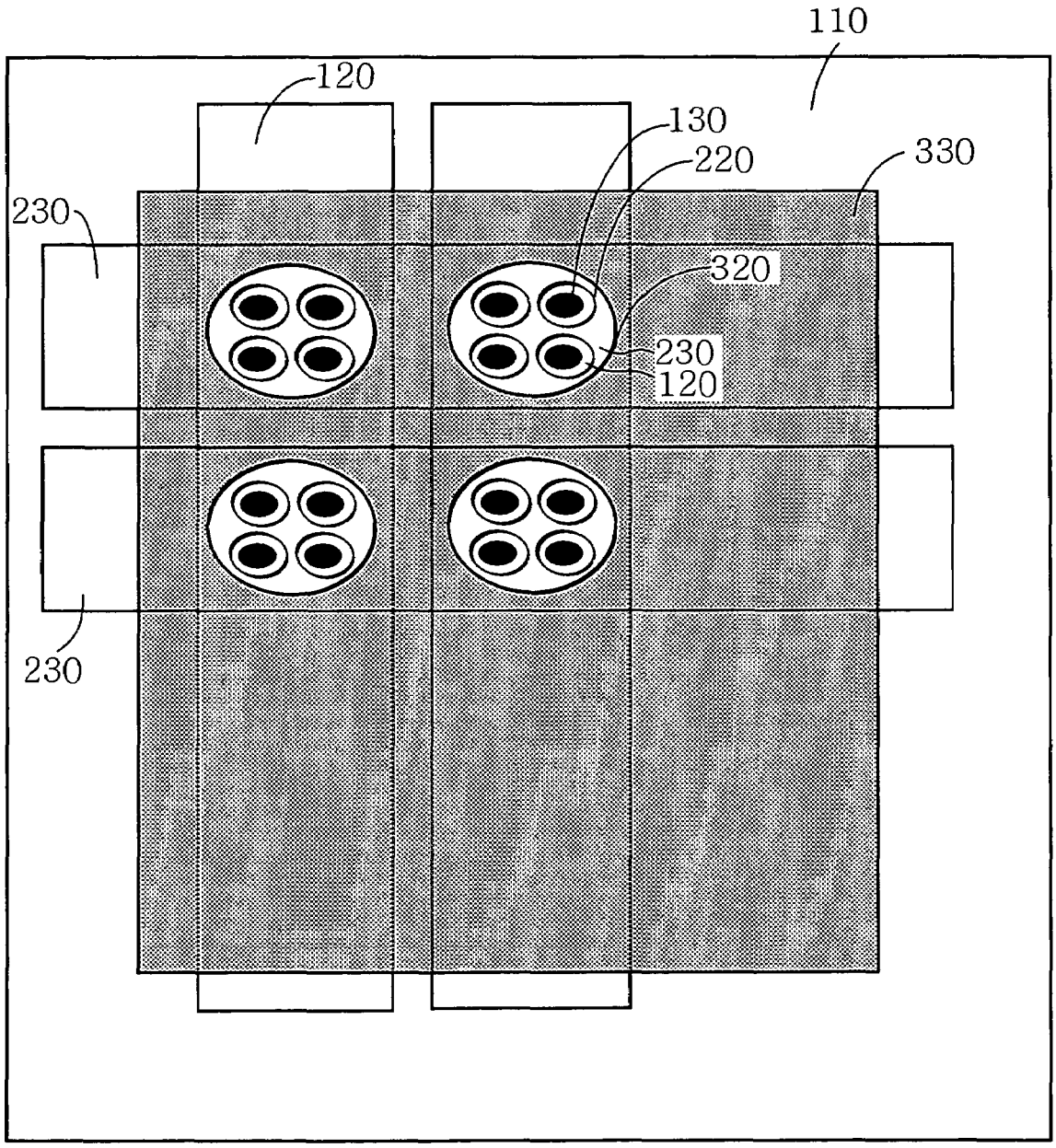
FIG. 5 is a plan view of a pixel array for explaining the structure in which the pixels of FIG. 4 are arranged in a matrix form.

FIG. 4 is a cross sectional view for explaining a configuration of one dot pixel in a field emission display in accordance with a first embodiment of the present invention, and FIG. 5 is a plan view of a pixel array for explaining the structure in which the pixels of FIG. 4 are arranged in a matrix form.

Referring to FIG. 4, an anode 400 comprises a transparent electrode 420, phosphor materials 430 of Red (R), Green (G) and Blue (B) colors on some portion of the transparent electrode 420, and a black matrix 440 interposed between adjacent phosphor materials on an anode substrate 410 formed of a transparent insulating substrate such as glass. The cathode 100, field emission suppressing gate 200, field emission inducing gate 300, and the anode 400 are vacuum-packaged and supported by spacers 500 to have the arranged electric field emitter 130 of the cathode 100 face the phosphor materials 430 of the anode through the field emission suppressing gate opening 220 of the field emission suppressing gate 200 and the field emission inducing gate opening 320 of the field emission inducing gate 300. In this case, the spacer 500 acts to maintain a space between the anode 400, and the cathode 100, field emission suppressing gate 200, field emission inducing gate 300; the spacer is not necessarily formed in all pixels.

Hereinafter, an example of driving the field emission device will be described in detail.

First, a constant direct current voltage (e.g. 100V to 1500V) is applied to the field emission inducing gate electrode 330 of the field emission inducing gate 300 to induce electrons emitted from the electric field emitter 130 of the cathode 100 while a direct current high voltage (e.g. 1000V to 15000V) is concurrently applied to the anode electrode 420 of the anode 400 to accelerate the emitted electrons with high energy. A display scan pulse signal having a negative voltage of 0V to about −50V is applied to the field emission suppressing gate electrode 230 and a data pulse signal having a positive voltage of 0V to about 50V or a negative voltage of 0V to about −50V is applied to the cathode electrode 120 to thereby display images.

In this case, gray representation of the display may be obtained by adjusting the pulse amplitude or pulse width of the data signal applied to the cathode electrode 120.

Referring to FIG. 5, a plurality of dot pixels shown in FIG. 4 are arranged in a matrix form, wherein the cathode electrode 120 and the field emission suppressing gate electrode 230 are arranged as column and row addressing electrodes, respectively. The anode 400 is not shown in FIG. 5 and the size of the electric field emitter 130 is shown to be smaller than the field emission inducing gate opening 320. However, it is apparent that the size can be larger than the field emission inducing gate opening 320 in actual implementation.

Second Embodiment

Figure 6:
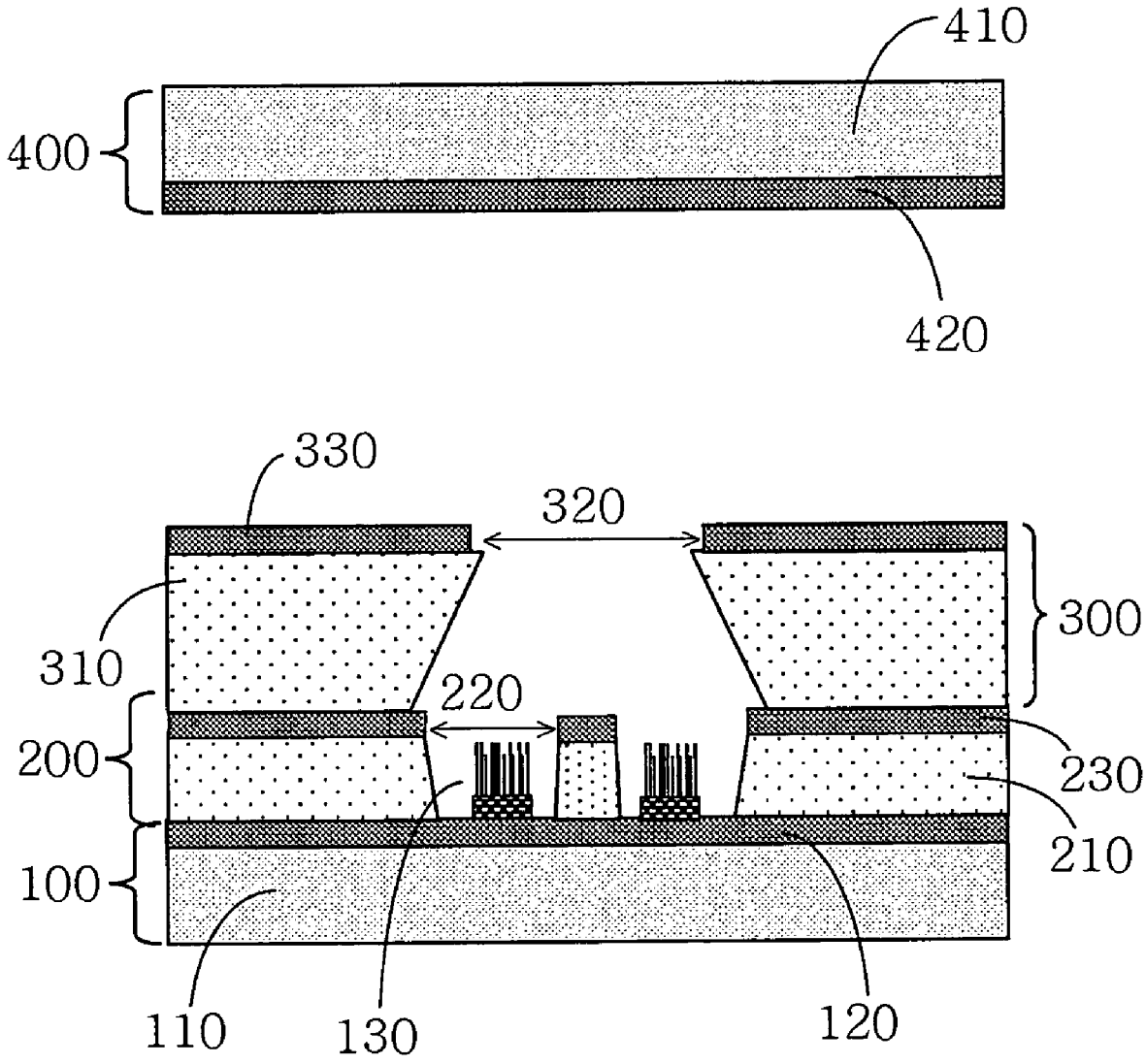
FIG. 6 is a diagram illustrating a schematic configuration of a field emission device in accordance with a second embodiment of the present invention.
Figure 7:
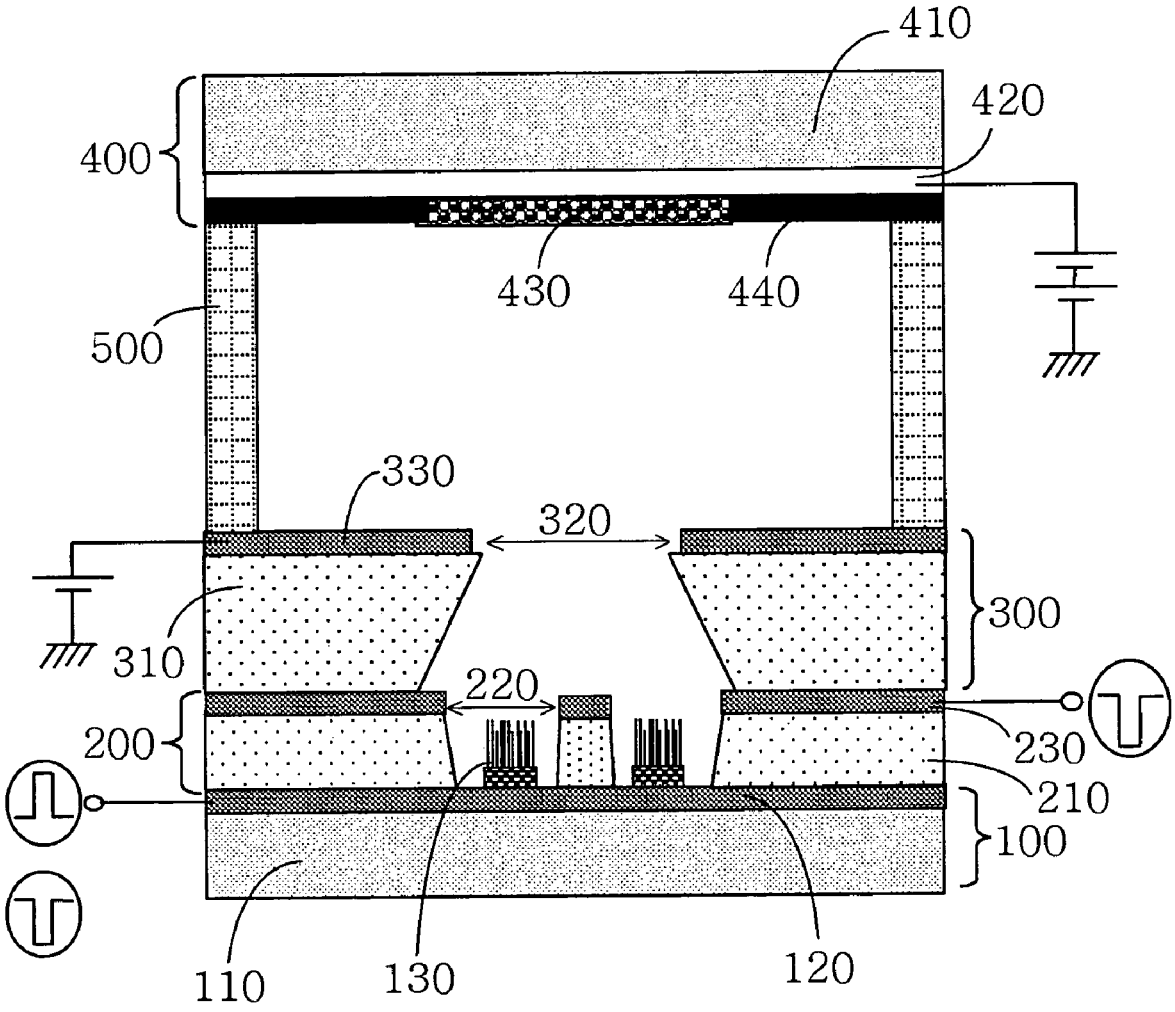
FIG. 7 is a cross sectional view for explaining a configuration of one dot pixel in a field emission device in accordance with a second embodiment of the present invention.
Figure 8:
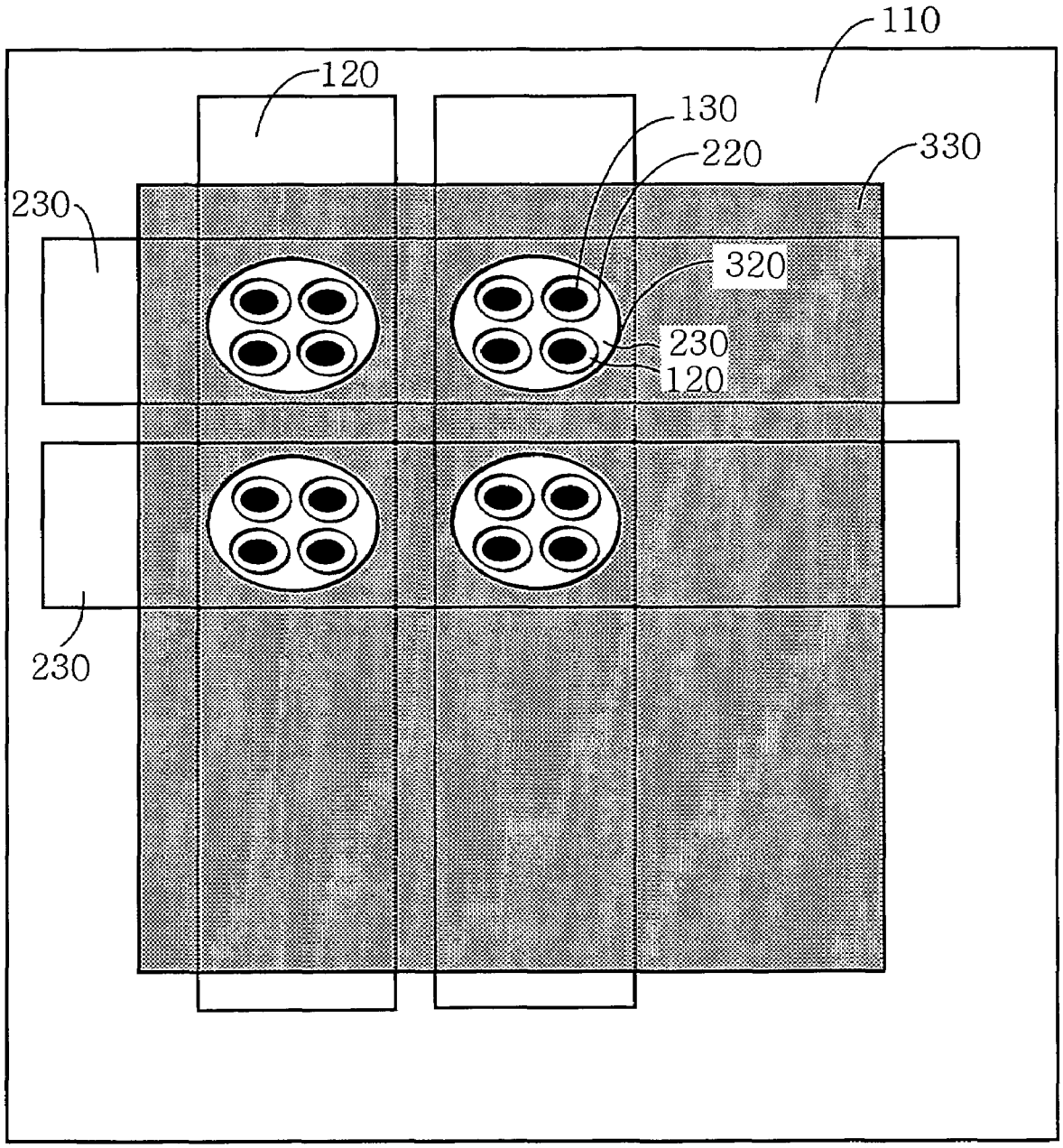
FIG. 8 is a plan view of a pixel array for explaining the structure in which the pixels of FIG. 7 are arranged in a matrix form.

Next, the field emission device in accordance with a second embodiment of the present invention will be described in detail with reference to FIG. 6 to FIG. 8. For simplicity of description, the difference between the first and second embodiments will be described in detail. FIG. 6 is a diagram illustrating a schematic configuration of a field emission device in accordance with the second embodiment of the present invention. FIG. 7 is a cross sectional view for explaining a configuration of one dot pixel in a field emission display in accordance with the second embodiment of the present invention. FIG. 8 is a plan view of a pixel array for explaining the structure in which the pixels of FIG. 7 are arranged in a matrix form.

The second embodiment differs from the first embodiment in that the field emission suppressing gate opening is separated into at least two regions. Each region has a separate electric field emitter.

In accordance with the second embodiment, it is advantageous that the field emission suppressing effect using the field emission suppressing gate may be enhanced. Thus, field emission may be readily focused and controlled while maximizing the current.

The size of each electric field emitter may be determined in a range of about 0.5 um to about 10 um, and the size of the field emission suppressing gate opening may be determined in a range of about 1 um to 10 um. In the meantime, the voltage of the field emission suppressing gate may be decreased or the current density of field emission may be increased, as compared to the first embodiment, in consideration of actual driving conditions.

In accordance with the above-mentioned configurations, an electric field necessary for field emission is applied through the gate electrode of the field emission inducing gate when the field emission device of the present invention is applied to the field emission display, so that the space between the anode and the cathode may be readily adjusted and a high voltage may be applied to the anode, which leads to a significant enhancement of brightness of the field emission display.

The field emission device of the present invention may significantly improve problems such as gate leakage current, electron emission due to the anode voltage, and electron beam spreading which occur in the conventional carbon field emission device.

In addition, the voltage applied to the field emission inducing gate electrode suppresses the electron emission from the electric field emitter due to the anode voltage and forms uniform electric potential between the anode and the gate, so that local arcing may be prevented while the life span of the field emission display may be significantly enhanced.

The field emission inducing gate opening having the inclined inner wall of the field emission inducing gate acts to focus the electrons emitted from the electric field emitter on the phosphor material of the corresponding anode, which leads to fabrication of the field emission display with a high resolution.

While the present invention has been described with reference to particular embodiments, it is understood that the disclosure has been made for the purpose of illustrating the invention by way of examples and is not intended to limit the scope of the invention. One skilled in the art would understand that amendments and changes may be need to the present invention without departing from the scope and spirit of the invention.

What is claimed is:

1. A field emission device comprising:

a cathode including a cathode substrate, a cathode electrode formed on the cathode substrate, and an electric field emitter formed on a portion of the cathode electrode;

a field emission suppressing gate formed on the cathode substrate to surround the electric field emitter;

a field emission inducing gate formed on the field emission suppressing gate, wherein the field emission inducing gate includes a field emission inducing gate opening that is formed to have an inclined inner wall such that the size of the opening becomes smaller toward an anode from the cathode; and the anode including an anode electrode an anode including an anode electrode facing the electric field emitter for receiving electrons emitted from the electric field emitter, wherein the field emission suppressing gate suppresses electron emission from the electric field emitter, and the field emission inducing gate induces electron emission from the electric field emitter.

2. The field emission device as claimed in claim 1, wherein the field emission suppressing gate includes a first insulator having an inner field emission suppressing gate opening so as to electrically insulate from the cathode electrode and the electric field emitter, and a field emission suppressing gate electrode formed on the first insulator.

3. The field emission device as claimed in claim 2, wherein the size of the field emission suppressing gate opening is one to twenty times the thickness of the first insulator.

4. The field emission device as claimed in claim 1, wherein the field emission inducing gate includes a second insulator having an inner field emission suppressing gate opening so as to electrically insulate the field emission inducing gate from the field emission suppressing gate electrode of the field emission suppressing gate, and a field emission inducing gate electrode formed on the second insulator.

5. The field emission device as claimed in claim 4, wherein the size of the field emission inducing gate opening is one to three times the thickness of the second insulator.

6. The field emission device as claimed in claim 4, wherein the field emission inducing gate electrode is formed not to cover the inner wall of the field emission inducing gate opening.

7. The field emission device as claimed in claim 1, wherein the electric field emitter includes a carbon electric field emitter capable of being formed of any one of diamond, diamond like carbon, carbon nanotube, and carbon nanofiber.

8. The field emission device as claimed in claim 7, wherein the carbon electric field emitter is formed by direct growing any one of diamond, diamond like carbon, carbon nanotube, and carbon nanofiber on the cathode electrode by means of catalytic metal.

9. The field emission device as claimed in claim 7, wherein the carbon electric field emitter is formed by mixing and printing with paste any one of powder type diamond, diamond like carbon, carbon nanotube, and carbon nanofiber.

10. The field emission device as claimed in claim 1, wherein the cathode, field emission suppressing gate and field emission inducing gate are formed on one substrate and the anode is formed on another substrate.

11. The field emission device as claimed in claim 1, wherein the field emission suppressing gate, field emission inducing gate, and anode are vacuum-packaged to have the electric field emitter of the cathode face the anode electrode of the anode through the field emission suppressing gate opening and the field emission inducing gate opening.

12. The field emission device as claimed in claim 1, wherein a constant direct current voltage is applied to the field emission inducing gate electrode to induce electrons emitted from the electric field emitter of the cathode, a scan signal having a negative voltage is applied to the field emission suppressing gate, and a data signal having any one of positive and negative voltages is applied to the cathode so that an image is represented.

13. The field emission device as claimed in claim 12, wherein gray representation is displayed by adjusting any one of a pulse amplitude and a pulse width of the data signal.

14. The field emission device as claimed in claim 1, wherein the anode includes a transparent substrate, a transparent electrode formed on the transparent substrate, phosphor materials of colors on a portion of the transparent electrode, and a black matrix interposed between adjacent phosphor materials.

15. The field emission device as claimed in claim 1, wherein the cathode, field emission suppressing gate, and field emission inducing gate are supported by spacers to face the anode.

16. The field emission device as claimed in claim 1, wherein the field emission suppressing gate is separated to include at least two openings, and each opening of the field emission suppressing gate includes an electric field emitter therein.

17. A field emission device comprising a cathode including an electric field emitter for emitting electrons, a field emission inducing gate for inducing electron emission, an anode for receiving the emitted electrons, and a field emission suppressing gate interposed between the cathode and the field emission inducing gate for suppressing the electron emission, wherein the field emission inducing gate includes a field emission inducing gate opening that is formed to have an inclined inner wall such that the size of the opening becomes smaller toward the anode from the cathode.

18. The field emission device as claimed in claim 17, wherein an electric field is applied to the field emission inducing gate to allow electrons to be emitted from the electric field emitter, and an electric field is applied to the field emission suppressing gate in a direction opposite to that of the electric field induced to the electric field emitter due to the field emission inducing gate to suppress the electron emission from the electric field emitter.

* * * * *